US007416495B2

(12) United States Patent
Ban et al.

(10) Patent No.: US 7,416,495 B2
(45) Date of Patent: Aug. 26, 2008

(54) GOLF CLUB

(75) Inventors: Wataru Ban, Saitama (JP); Yoshihumi Nakajima, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/319,530

(22) Filed: Dec. 29, 2005

(65) Prior Publication Data

US 2007/0105640 A1 May 10, 2007

(30) Foreign Application Priority Data

Nov. 8, 2005 (JP) ..... 2005-324018

(51) Int. Cl.
*A63B 53/00* (2006.01)

(52) U.S. Cl. ..... 473/292; 473/316

(58) Field of Classification Search ..... 473/292, 473/297–299, 289–291, 316–323
See application file for complete search history.

(56) References Cited

U.S. PATENT DOCUMENTS

| | | | | |
|---|---|---|---|---|
| 3,703,824 A | | 11/1972 | Osborne et al. | |
| 4,058,312 A | | 11/1977 | Stuff et al. | |
| 4,887,815 A | * | 12/1989 | Hughes et al. | 473/291 |
| 5,879,241 A | * | 3/1999 | Cook et al. | 473/289 |
| 2002/0016214 A1 | * | 2/2002 | Hueber | 473/287 |
| 2003/0125125 A1 | * | 7/2003 | Oyama | 473/323 |
| 2005/0181887 A1 | | 8/2005 | Sano et al. | |

FOREIGN PATENT DOCUMENTS

| | | | |
|---|---|---|---|
| JP | 8-173577 A | | 7/1996 |
| JP | 10-155952 | * | 6/1998 |
| JP | 2001-46563 A | | 2/2001 |
| JP | 2005-198816 A | | 7/2005 |
| JP | 2005-304679 | * | 11/2005 |

* cited by examiner

*Primary Examiner*—Stephen L. Blau
(74) *Attorney, Agent, or Firm*—Sughrue Mion, PLLC

(57) ABSTRACT

This invention provides a wood type golf club including a shaft, a grip at one end of the shaft, and a head at the other end of the shaft, wherein a mass m (g) of the golf club and a length L (cm) from a grip side end of the golf club to a barycentric position of the golf club satisfy $m \times L \leqq 2.60 \times 10^4$ (g·cm) and $m \times L^2 \geqq 2.270 \times 10^6$ (g·cm$^2$), and the barycentric position of the shaft is within a range of 48.5% the total length of the shaft from a head side end of the shaft.

1 Claim, 3 Drawing Sheets

FIG. 2A

| | TOTAL MASS m (g) | BARYCENTRIC LENGTH L (cm) | PRIMARY MOMENT M ($\times 10^4$g·cm) | SECONDARY MOMENT I ($\times 10^6$g·cm$^2$) | TOTAL LENGTH Lw (INCH) | LOFT ANGLE (degree) | MASS OF GRIP (g) | MASS OF SHAFT (g) | SHAFT BARYCENTRIC POSITION* (%) | SHAFT TORQUE (degree) |
|---|---|---|---|---|---|---|---|---|---|---|
| COMMER-CIALLY AVAILABLE PRODUCT A | 300.4 | 87.1 | 2.62 | 2.279 | 45 | 10.0 | 46.2 | 50.8 | 53.8 | 4.4 |
| COMMER-CIALLY AVAILABLE PRODUCT B | 290.6 | 89.2 | 2.59 | 2.312 | 45 | 11.0 | 44.6 | 49.3 | 49.4 | 4.7 |
| EXAMPLE 1 | 279.8 | 90.7 | 2.54 | 2.302 | 45 | 11.5 | 38.0 | 46.3 | 47.8 | 4.8 |
| EXAMPLE 2 | 280.2 | 90.8 | 2.54 | 2.310 | 45 | 11.0 | 38.0 | 48.9 | 48.3 | 4.3 |

*: SHAFT BARYCENTRIC POSITION = LENGTH L'/ TOTAL SHAFT LENGTH Ls × 100

FIG. 2B

| | HEAD SPEED (m/s) | BALL INITIAL SPEED (m/s) | TRAVELING DISTANCE (YARD) | DEVIATION AMOUNT (YARD) | ORGANOLEPTIC EVALUATION |
|---|---|---|---|---|---|
| COMMERCIALLY AVAILABLE PRODUCT A | 44.0 | 59.7 | 221.3 | 25.4 | MOST DIFFICULT TO SWING |
| COMMERCIALLY AVAILABLE PRODUCT B | 44.4 | 60.5 | 229.0 | 22.5 | DIFFICULT TO SWING |
| EXAMPLE 1 | 44.8 | 60.9 | 232.1 | 5.8 | EASY TO SWING WITH ENHANCED FEEL AT IMPACT |
| EXAMPLE 2 | 45.0 | 61.5 | 234.6 | 3.0 | EASIEST TO SWING WITH ENHANCED FEEL AT IMPACT |

GOLF CLUB

FIELD OF THE INVENTION

The present invention relates to a golf club and, more particularly, to a wood type golf club such as a driver or fairway wood.

BACKGROUND OF THE INVENTION

Factors that influence the performance of a golf club include the primary moment and secondary moment (moment of inertia) of the golf club. The primary and secondary moments are respectively expressed as $m \times L$ and $m \times L^2$ where m is the mass of the golf club and L is the length from the grip side end of the golf club to the barycentric position of the golf club.

Japanese Patent Laid-Open Nos. 8-173577 and 2005-198816 disclose a golf club improved based on its primary moment. These references point out that when the primary moment is decreased, the golfer can easily increase the head speed and can expect that the traveling distance of a ball will increase. On the other hand, the golf club becomes lighter and the swing orbit of the golf club becomes unstable thus degrading the direction of the ball.

Japanese Patent Laid-Open No. 2001-46563 discloses a golf club improved by considering the secondary moment. Generally, it is known that the secondary moment of a golf club influences the feel at impact. When the secondary moment is large, the feel at impact is enhanced, and the golfer can easily swing the golf club fully. Also, the direction of the ball improves.

When the secondary moment is increased, however, the primary moment also increases accordingly. Consequently, the head speed decreases and reduces the traveling distance of the ball. Conventional golf clubs have been improved based on only either the primary or secondary moment and is difficult to increase the traveling distance of the ball and at the same time enhance the feel at impact.

SUMMARY OF THE INVENTION

The present invention has been made in order to overcome the deficits of prior art.

According to the aspects of the present invention, it is provided a wood type golf club comprising a shaft, a grip at one end of the shaft, and a head at the other end of the shaft, wherein a mass m (g) of the golf club and a length L (cm) from a grip side end of the golf club to a barycentric position of the golf club satisfy $m \times L \leqq 2.60 \times 10^4$ (g·cm) and $m \times L^2 \geqq 2.270 \times 10^6$ (g·cm$^2$), and the barycentric position of the shaft is within a range of 48.5% a total length of the shaft from a head side end of the shaft.

The golf club which has a comparatively small primary moment ($m \times L$) and a comparatively large secondary moment ($m \times L^2$) within ranges where the practical limitations on the lengths and masses of the golf club and its constituent components are satisfied. As a result, both an increase in traveling distance of the ball and enhanced feel at impact are achieved.

To decrease and increase the primary moment M and secondary moment I, respectively, of a golf club, the barycentric length L is significant. More specifically, if the barycentric length L is increased, the secondary moment I can be increased more. Even when the barycentric length L is large, if the mass m is decreased, the primary moment M decreases. In general, the closer the barycentric position of the shaft is to the head side, the more easily a golfer feels the weight of the head. This improves the enhanced feel at impact and the swing easiness of the club.

When the barycentric position of the shaft is within a range of 48.5% a total length of the shaft from the head side end of the shaft, the barycentric length L is easily increases. Therefore, the relationship between the mass m and barycentric length L is easily satisfied. In addition, the enhanced feel at impact and the swing easiness of the club are further improved.

Other features and advantages of the present invention will be apparent from the following descriptions taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

FIG. 2A is a table showing the specifications of examples of the present invention and comparative examples; and FIG. 2B is a table showing the evaluation results of the examples of the present invention and the comparative examples.

DETAILED DESCRIPTION OF THE PREFERRED EMBODIMENT

A preferred embodiment of the present invention will now be described in detail in accordance with the accompanying drawings.

Figure 1A:
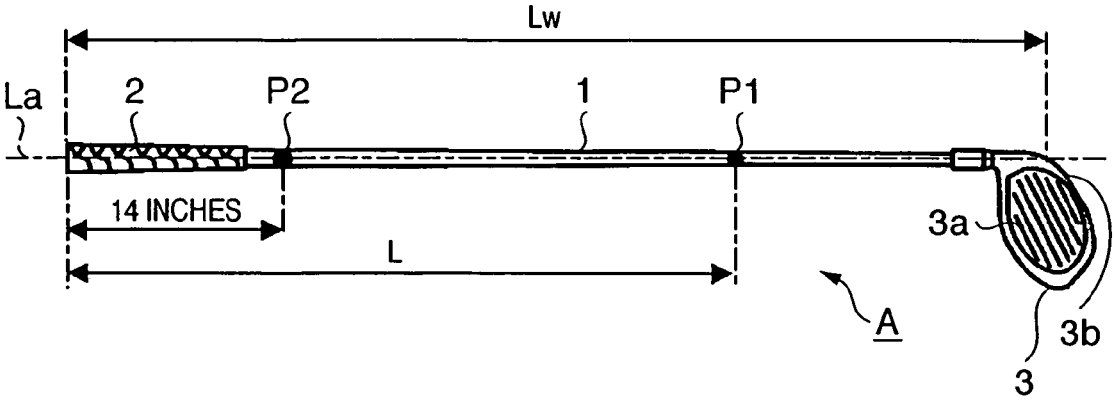
FIG. 1A is a view for explaining a golf club A according to an embodiment of the present invention.

FIG. 1A is a view for explaining a wood type golf club A according to an embodiment of the present invention. The golf club A has a shaft 1, a grip 2 attached to one end of the shaft 1, and a head 3 attached to the other end of the shaft 1. The head 3 has a face portion 3*a* which serves as a golf ball hitting surface and a sole portion 3*b* which forms the bottom surface of the head 3.

In FIG. 1A, reference symbol Lw denotes the total length of the golf club A, which indicates the length between the grip 2 side end of the golf club A and the intersection of an axis La of the shaft 1 and the sole portion 3*b*. A point P1 indicates the barycentric position of the golf club A, where the golf club A balances with its shaft 1 being in a substantially horizontal state. A point P2 indicates a position 14 inches from the grip 2 side end of the golf club A in the direction of the axis La.

A primary moment M (g·cm) and secondary moment I (g·cm$^2$) of the golf club A are respectively expressed as:

$$M = m \times L$$

$$I = m \times L^2$$

where m (g) is the mass (total mass) of the golf club A and L (cm) is the length (to be referred to as the barycentric length hereinafter) from the grip 2 side end to the barycentric position P1 of the golf club A.

This embodiment is aimed at maximizing the secondary moment while minimizing the primary moment to achieve both an increase in traveling distance of the ball and enhanced feel at impact. The secondary moment I is a value obtained by multiplying the primary moment M by the barycentric length L. Accordingly, the primary moment M and secondary moment I tend to change basically in the same manner. Generally, a certain practical limitation is imposed on the lengths and masses of the golf club and its constituent components. In the case of a wood type golf club, for example, the mass of the grip is about 40 g to 55 g, the mass of the shaft is about 40 g to 65 g, and the mass of the head is about 180 g to 200 g. The total mass of the golf club is about 260 g to 340 g.

In this embodiment, the mass m and barycentric length L are set to satisfy:

$$M=m\times L\leqq 2.60\times 10^4\ (\text{g}\cdot\text{cm}) \quad (1)$$

$$I=m\times L^2\geqq 2.270\times 10^6\ (\text{g}\cdot\text{cm}^2) \quad (2)$$

These requirements are realized by adjusting the masses and barycentric positions of the shaft 1, grip 2, and head 3 which are constituent components of the golf club A.

To further decrease and increase the primary moment M and secondary moment I, respectively, of the golf club A, the barycentric length L is significant. More specifically, if the barycentric length L is increased, the secondary moment I can be increased more. Even when the barycentric length L is large, if the mass m is decreased, the primary moment M decreases.

Figure 1B:
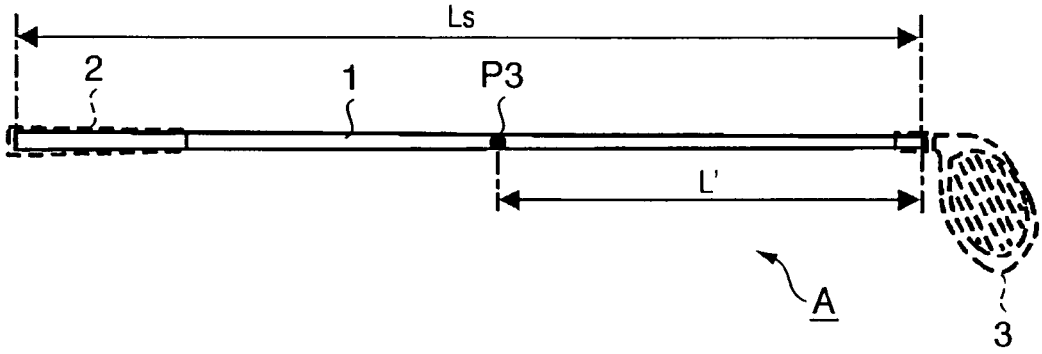
FIG. 1B is a view for explaining a shaft 1.

For this reason, the specifications of the shaft 1 are contrived in this embodiment. FIG. 1B is a view for explaining the shaft 1. In FIG. 1B, reference symbol Ls denotes the total length of the shaft 1. A point P3 indicates the barycentric position of the shaft 1 alone. When the shaft 1 is substantially horizontal, the shaft 1 balances at the point P3. Reference symbol L' denotes the length from the head 3 side (tip side) end of the shaft 1 to the barycentric position P3.

The barycentric position P3 of the shaft 1 is set to fall within the range of 48.5% the total length Ls of the shaft 1 from the head 3 side end of the shaft 1, that is, to satisfy:

$$L'\leqq 0.485\times Ls \quad (3)$$

When the weight of the head 3 side of the golf club A is increased, a larger barycentric length L can be ensured more easily, and the primary moment M and secondary moment I of the golf club A can be set within the above numerical ranges more easily. In general, the closer the barycentric position of the shaft is to the head side, the more easily a golfer feels the weight of the head. This improves the enhanced feel at impact and the swing easiness of the club. Therefore, the enhanced feel at impact of the head 3 and the swing easiness of the golf club A are further improved.

The golf club A according to this embodiment provides a golf club which has a comparatively small primary moment M and a comparatively large secondary moment I within ranges where the practical limitations on the lengths and masses of the golf club A and its constituent components are satisfied. As a result, both an increase in traveling distance of the ball and enhanced feel at impact are achieved.

Preferably, the primary moment M and secondary moment I are respectively set in the following ranges:

$$2.45\times 10^4\ (\text{g}\cdot\text{cm})\leqq M\leqq 2.56\times 10^4\ (\text{g}\cdot\text{cm})$$

$$2.300\times 10^6\ (\text{g}\cdot\text{cm}^2)\leqq I\leqq 2.500\times 10^6\ (\text{g}\cdot\text{cm}^2)$$

If the barycentric position P3 of the shaft 1 is extremely closer to the head 3 side, the strength of the shaft 1 may decrease. Therefore, preferably, the barycentric position P3 of the shaft 1 falls within the range of 45% to 48.5% the total length Ls of the shaft 1 from the head 3 side end of the shaft 1, that is, satisfies $0.450\times Ls\leqq L'\leqq 0.485\times Ls$.

The mass of the shaft 1 is preferably 50 (g) or less. When the weight of the shaft 1 is decreased, the mass m of the golf club A can be decreased more to decrease the primary moment M. If the weight of the shaft 1 is excessively decreased, however, the strength of the shaft 1 may decrease. Therefore, the mass of the shaft 1 is preferably within the range of 30 (g) to 50 (g) (both inclusive).

The torque (twisting angle formed when a predetermined torque acts on the shaft 1) of the shaft 1 is preferably 4.5 degrees or less. If the torque of the shaft 1 is small, a best impact timing is difficult to obtain. If the torque is large, the ball directivity tends to degrade. Therefore, the torque of the shaft 1 is further preferably within a range of 2.0 degrees to 4.5 degrees (both inclusive).

The mass m of the golf club A is preferably within the range of 260 (g) to 300 (g) (both inclusive). If the golf club A is excessively lightweight, the golfer may feel it difficult to swing the golf club A. If the mass m falls within this range, the above effect can be obtained while solving the swing difficulty of the golf club A.

The total length Lw of the golf club A can be set within a range of 41 inches to 50 inches (both inclusive), and the loft angle of the face portion 3*a* of the head 3 can be set to 25 degrees or less. To set the total length and loft angle of the golf club within these ranges is preferable for a wood type golf club such as a driver or fairway wood for which an increase in traveling distance of the ball is regarded significant. Furthermore, when the golf club A according to this embodiment is a driver, the total length Lw is preferably set within a range of 44 inches to 48 inches (both inclusive) and the loft angle is set within a range of 5 degrees to 15 degrees (both inclusive).

The golf club A according to this embodiment preferably has a club balance of C7 to D5 according to the 14-inch method. The 14-inch method is a known method of evaluating the club balance of a golf club. This method will be described with reference to FIG. 1A. According to the 14-inch method, the load of the grip 2 side end of the golf club A when the shaft 1 is maintained substantially horizontal with the point P2 being as the fulcrum is converted to be used as an evaluation index. If the club balance of the golf club A is within the above range, the above effect can be obtained within the range of the club balance of a general golf club. With this golf club, address and swing can be performed naturally when compared to a general golf club. It is further preferable if the club balance of the golf club A is C8 to D2 according to the 14-inch method.

It is preferable to set the mass of the grip 2 to 40 (g) or less. When the weight of the grip 2 side of the golf club A is decreased, a larger barycentric length L can be ensured more easily, and the primary moment M and secondary moment I of the golf club A can be set within the above numerical ranges easily. If the weight of the grip 2 is excessively decreased, the wall thickness of the grip 2 may be decreased to impair the grip feel of the golfer. Therefore, more preferably, the mass of the grip 2 is set within a range of 25 (g) to 40 (g) (both inclusive). Within this range, the above effect can be obtained without largely impairing the grip feel of the grip 2.

EXAMPLE

Performance evaluation was performed using the examples of the present invention and commercially available golf clubs as comparative examples. FIG. 2A is a table showing the specifications of the examples (Examples 1 and 2) of the present invention and comparative examples (commercially available products A and B), each of which is a driver. The symbols (m, M, I, and L'/Ls) of the respective parameters correspond to the reference symbols described above. Neither a primary moment M nor shaft barycentric position of the commercially available product A satisfy equations (1) and (3), respectively. Of the commercially available product B, a primary moment M and secondary moment I satisfy equations (1) and (2), respectively, but a shaft barycentric position does not satisfy equation (3). Of each of Examples 1 and 2, both a primary moment M and secondary moment I satisfy equations (1) and (2), respectively, and a shaft barycentric position satisfies equation (3). Among Examples 1 and 2 and the commercially available products A and B, no substantial difference exists concerning the total length Lw and the loft angle that mainly influence the traveling distance of the ball.

FIG. 2B is a table showing the evaluation results of Examples 1 and 2 and commercially available products A and B. The performance evaluation was conducted in the following manner. Five testers hit the golf ball as a test hitting using the golf clubs of Examples 1 and 2 and commercially available products A and B. Of the trial hits, three hits with good traveling distances and directions were selected as the evaluation targets. The respective parameters shown in FIG. 2B of the evaluation targets were averaged. Of the parameters shown in FIG. 2B, "deviation amount" indicates the leftward or rightward distance from the target traveling direction of the ball to the actual falling point of the ball, which serves as the index of the directivity of the ball. The organoleptic evaluation is the comment formed by the five testers through exchanging opinions on the relative swing easiness and the like of each club after the test hitting.

From the results of the performance evaluation of FIG. 2B, Examples 1 and 2 are superior to the commercially available products A and B in head speed. Each of Examples 1 and 2 has a smaller deviation amount than that of either one of the commercially available products A and B, and has a better enhanced feel at impact as the organoleptic evaluation.

The commercially available product A has the slowest head speed. This may be because the primary moment M of the commercially available product A is larger than that of other golf clubs. Although the primary moment M and secondary moment I of the commercially available product B satisfy equations (1) and (2), respectively, it is inferior to Examples 1 and 2. This may be because the difference in the shaft barycentric position influences the club performance. The primary moment M of the commercially available product B is larger than those of Examples 1 and 2. This difference may also influence the club performance.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2005-324018 filed on Nov. 8, 2005, the entire contents of which are hereby incorporated by reference herein.

What is claimed is:

1. A wood type golf club comprising a shaft, a grip at one end of said shaft, and a head at the other end of said shaft, wherein a mass m (g) of the golf club and a length L (cm) from a grip side end of the golf club to a barycentric position of the golf club satisfy $m \times L = 2.54 \times 10^4 (g \cdot cm)$ and $m \times L^2 = 2.310 \times 10^6 (g \cdot cm^2)$, and a barycentric position of said shaft is at 48.3% a total length of said shaft from a head side end of said shaft, wherein the mass m (g) is 280.2, the length L (cm) is 90.8 (cm), a loft angle of a face of said head is 11 degrees, a mass (g) of said grip is 38.0, a mass of said shaft is 48.9 (g), and a torque of said shaft is 4.3 degrees.

* * * * *